US006460871B1

(12) United States Patent
Dodge

(10) Patent No.: US 6,460,871 B1
(45) Date of Patent: Oct. 8, 2002

(54) STEP-IN SNOWBOARD BINDING

(75) Inventor: David J. Dodge, Williston, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/691,513

(22) Filed: Oct. 18, 2000

Related U.S. Application Data

(63) Continuation-in-part of application No. 09/510,796, filed on Feb. 23, 2000, now abandoned, which is a continuation of application No. 08/753,343, filed on Nov. 25, 1996, now Pat. No. 6,050,005, which is a continuation of application No. 08/674,976, filed on Jul. 3, 1996, now Pat. No. 5,941,555, which is a continuation of application No. 08/375,971, filed on Jan. 20, 1995, now abandoned.

(51) Int. Cl.[7] ..... A63C 9/20

(52) U.S. Cl. ..... 280/624; 280/14.22; 280/625

(58) Field of Search ..... 280/624, 625, 280/617, 618, 607, 14.21, 14.22, 14.24, 633

(56) References Cited

U.S. PATENT DOCUMENTS

| | | | |
|---|---|---|---|
| 3,140,877 | A | 7/1964 | Spademan |
| 3,271,040 | A | 9/1966 | Spademan |
| 3,280,411 | A | 10/1966 | Brock |
| 3,494,628 | A | 2/1970 | Spademan |
| RE26,972 | E | 10/1970 | Spademan |
| 3,545,103 | A | 12/1970 | Bloomfield et al. |
| 3,560,011 | A | 2/1971 | Spademan |
| 3,797,841 | A | 3/1974 | McAusland |
| 3,824,713 | A | 7/1974 | Vaccari |
| 3,852,896 | A | 12/1974 | Pyzel et al. |

(List continued on next page.)

FOREIGN PATENT DOCUMENTS

| | | | | |
|---|---|---|---|---|
| CH | 678494 | A5 | | 9/1991 |
| DE | 3910156 | A1 | | 10/1990 |
| DE | 4435960 | | | 10/1994 |
| DE | 4344647 | A1 | | 6/1995 |
| DE | 296 01682 | U1 | | 2/1996 |
| DE | 44 35 960 | | | 3/1996 |
| DE | 4435960 | C1 | * | 3/1996 |
| EP | 0350411 | A2 | | 1/1990 |
| EP | 0397969 | A2 | | 11/1990 |
| EP | 0669147 | A2 | | 8/1995 |
| EP | 0712646 | A1 | | 5/1996 |
| FR | 2 628 981 | | | 9/1989 |
| FR | 2 644 074 | | | 9/1990 |
| FR | 2 652 753 | | | 4/1991 |
| FR | 2689 776 | | | 10/1993 |
| FR | 2732239 | | | 10/1996 |
| JP | 07-303728 | | | 11/1995 |
| WO | WO 9603185 | A1 | | 6/1995 |
| WO | WO 96/05894 | | | 2/1996 |
| WO | WO 96/26774 | | | 9/1996 |

OTHER PUBLICATIONS

European Search Report.
Translation of DE 44 35 960.
Partial Translation of JP Laying Open No. 7–303728.
Regnod'Italia, Ministero Delle Corporazioni, Ufficio Della Proprieta Intel□ettuale.
Brevetto Industriale N. 322456, Aldo Marzot, Stampato nel dicembre 1935—A.XIV.

*Primary Examiner*—Robert P. Olszewski
*Assistant Examiner*—James S. McClelllan
(74) *Attorney, Agent, or Firm*—Wolf, Greenfield & Sacks, P.C.

(57) ABSTRACT

A snowboard binding for securing a boot to a board, comprising a base, a first engagement member that is supported by the base and adapted to engage a first lateral side of the boot, and a second engagement member, pivotally mounted to the base, that is adapted to engage a second lateral side of the boot opposite the first lateral side of the boot.

47 Claims, 10 Drawing Sheets

U.S. PATENT DOCUMENTS

| | | | | | |
|---|---|---|---|---|---|
| 3,869,136 | A | | 3/1975 | Jackson | |
| 3,884,492 | A | | 5/1975 | Spademan | |
| 3,888,497 | A | | 6/1975 | Zahradka | |
| 3,900,204 | A | | 8/1975 | Weber | |
| 3,944,240 | A | | 3/1976 | Bodendorfer | |
| 3,957,280 | A | | 5/1976 | Turnheim et al. | |
| 3,972,134 | A | | 8/1976 | Kastinger | |
| 3,988,841 | A | | 11/1976 | Salomon | |
| 4,026,045 | A | | 5/1977 | Druss | |
| 4,042,257 | A | * | 8/1977 | Salomon | 280/624 |
| 4,097,062 | A | * | 6/1978 | Salomon | 280/618 |
| 4,155,179 | A | | 5/1979 | Weninger | |
| 4,157,191 | A | * | 6/1979 | Ramer | 280/614 |
| 4,177,584 | A | | 12/1979 | Beyl | |
| 4,182,525 | A | * | 1/1980 | Spademan | 280/624 |
| 4,270,770 | A | | 6/1981 | Spademan | |
| 4,352,508 | A | | 10/1982 | Spademan | |
| 4,387,517 | A | | 6/1983 | Annovi | |
| 4,395,055 | A | | 7/1983 | Spademan | |
| 4,403,785 | A | | 9/1983 | Hottel | |
| 4,492,387 | A | | 1/1985 | Spademan | |
| 4,652,007 | A | | 3/1987 | Dennis | |
| 4,669,202 | A | | 6/1987 | Ottieri | |
| 4,728,116 | A | | 3/1988 | Hill | |
| 4,741,550 | A | | 5/1988 | Dennis | |
| RE33,350 | E | | 9/1990 | Stuart | |
| 4,964,649 | A | | 10/1990 | Chamberlin | |
| 4,973,073 | A | * | 11/1990 | Raines et al. | 280/624 |
| 4,979,760 | A | | 12/1990 | Derrah | |
| 5,016,902 | A | | 5/1991 | Goud et al. | |
| 5,028,068 | A | | 7/1991 | Donovan | |
| 5,035,443 | A | | 7/1991 | Kincheloe | |
| 5,044,654 | A | | 9/1991 | Meyer | |
| 5,044,656 | A | | 9/1991 | Peyre | |
| 5,054,807 | A | | 10/1991 | Fauvet | |
| 5,069,463 | A | | 12/1991 | Baud et al. | |
| 5,085,455 | A | | 2/1992 | Bogner et al. | |
| 5,094,470 | A | | 3/1992 | Riedel | |
| 5,121,939 | A | | 6/1992 | Peyre | |
| 5,143,396 | A | | 9/1992 | Shaanan et al. | |
| 5,145,202 | A | | 9/1992 | Miller | |
| 5,172,924 | A | | 12/1992 | Barci | |
| 5,188,386 | A | | 2/1993 | Schweizer | |
| 5,213,356 | A | | 5/1993 | Rohrmoser | |
| 5,232,241 | A | | 8/1993 | Knott et al. | |
| 5,236,216 | A | | 8/1993 | Ratzek | |
| 5,299,823 | A | * | 4/1994 | Glaser | 280/625 |
| 5,344,179 | A | | 9/1994 | Fritschi et al. | |
| 5,354,088 | A | | 10/1994 | Vetter et al. | |
| 5,401,041 | A | | 3/1995 | Jespersen | |
| 5,409,244 | A | | 4/1995 | Young | |
| 5,417,443 | A | | 5/1995 | Blattner et al. | |
| 5,474,322 | A | | 12/1995 | Perkins et al. | |
| 5,480,176 | A | | 1/1996 | Sims | |
| 5,499,461 | A | | 3/1996 | Danezin et al. | |
| 5,505,477 | A | | 4/1996 | Turner et al. | |
| 5,520,406 | A | | 5/1996 | Anderson et al. | 280/624 |
| 5,544,909 | A | | 8/1996 | Laughlin et al. | |
| 5,669,630 | A | | 9/1997 | Perkins et al. | 280/613 |
| 5,690,351 | A | * | 11/1997 | Karol | 280/618 |
| 5,697,631 | A | | 12/1997 | Ratzek et al. | |
| 5,941,555 | A | * | 8/1999 | Dodge | 280/623 |

* cited by examiner

STEP-IN SNOWBOARD BINDING

RELATED APPLICATIONS

This application is a continuation-in-part of application Ser. No. 09/510,796, filed Feb. 23, 2000, entitled SNOWBOARD BOOT BINDING MECHANISM, now abandoned, which is a continuation of application Ser. No. 08/753,343, filed Nov. 25, 1996, entitled SNOWBOARD BOOT BINDING MECHANISM, now U.S. Pat. No. 6,050,005, which is a continuation of application Ser. No. 08/674,976, filed Jul. 3, 1996, entitled SNOWBOARD BOOT BINDING MECHANISM, now U.S. Pat. No. 5,941,555, which is a file wrapper continuation of application Ser. No. 08/375,971, filed Jan. 20, 1995, entitled SNOWBOARD BOOT BINDING MECHANISM, now abandoned.

BACKGROUND OF THE INVENTION

1. Field of the Invention

The present invention relates to a snowboard binding for interfacing a boot to a snowboard.

2. Discussion of the Related Art

Most conventional binding systems for soft snowboard boots suffer from a disadvantage in that they are not "step-in" systems that can be automatically actuated by the rider simply stepping into the binding. These bindings typically include a rigid high back piece into which the heel of the boot is placed, and one or more straps that secure the boot to the binding. Such bindings can be somewhat inconvenient to use because after each run, the rider must unbuckle each strap to release the boot when getting on the chair lift, and must re-buckle each strap before the next run.

Other soft boot bindings have been developed that do not employ straps, but use rigid engagement members to releasably engage the boot to the binding. These systems typically include a handle or lever that must be actuated to move the engagement members into and out of engagement with the snowboard boot, and therefore, are not step-in systems that are automatically actuated by the rider simply stepping into the binding. The requirement that the handle or lever be mechanically actuated to lock the boot into the binding is disadvantageous because it makes it less convenient and more time consuming to engage the rider's boots to the snowboard each time the rider completes a run.

A further disadvantage of conventional bindings that employ rigid engagement members and an actuation handle or lever is that they generally employ a large spring that biases the binding to hold it in the closed position. Thus, to open the binding, the rider must exert substantial force on the handle or lever, making the binding difficult to use.

In view of the foregoing, it is an object of the present invention to provide an improved step-in binding for mounting a boot to a snowboard.

SUMMARY OF THE INVENTION

In one illustrative embodiment of the invention, a snowboard binding is provided for securing a boot to a snowboard. The binding comprises a base, a first engagement member that is supported by the base and adapted to engage a first lateral side of the boot, and a second engagement member, pivotally mounted to the base, that is adapted to engage a second lateral side of the boot opposite the first lateral side of the boot.

In another illustrative embodiment of the invention, the snowboard binding is provided with a trigger that is adapted to receive the bottom of the snowboard boot and, when moved via contact with the boot, to cause the pivotal engagement member to pivot into engagement with the snowboard boot.

BRIEF DESCRIPTION OF THE DRAWINGS

The invention will be better understood and appreciated from the following detailed description of illustrative embodiments thereof, and the accompanying drawings, in which.

DETAILED DESCRIPTION

The present invention is directed to a method and apparatus for engaging a snowboard boot to a snowboard. In accordance with one illustrative embodiment of the invention, a binding is provided that is automatically closed when a rider steps into the binding. Furthermore, the binding advantageously provides substantial locking force while requiring a small opening force.

Figure 1:
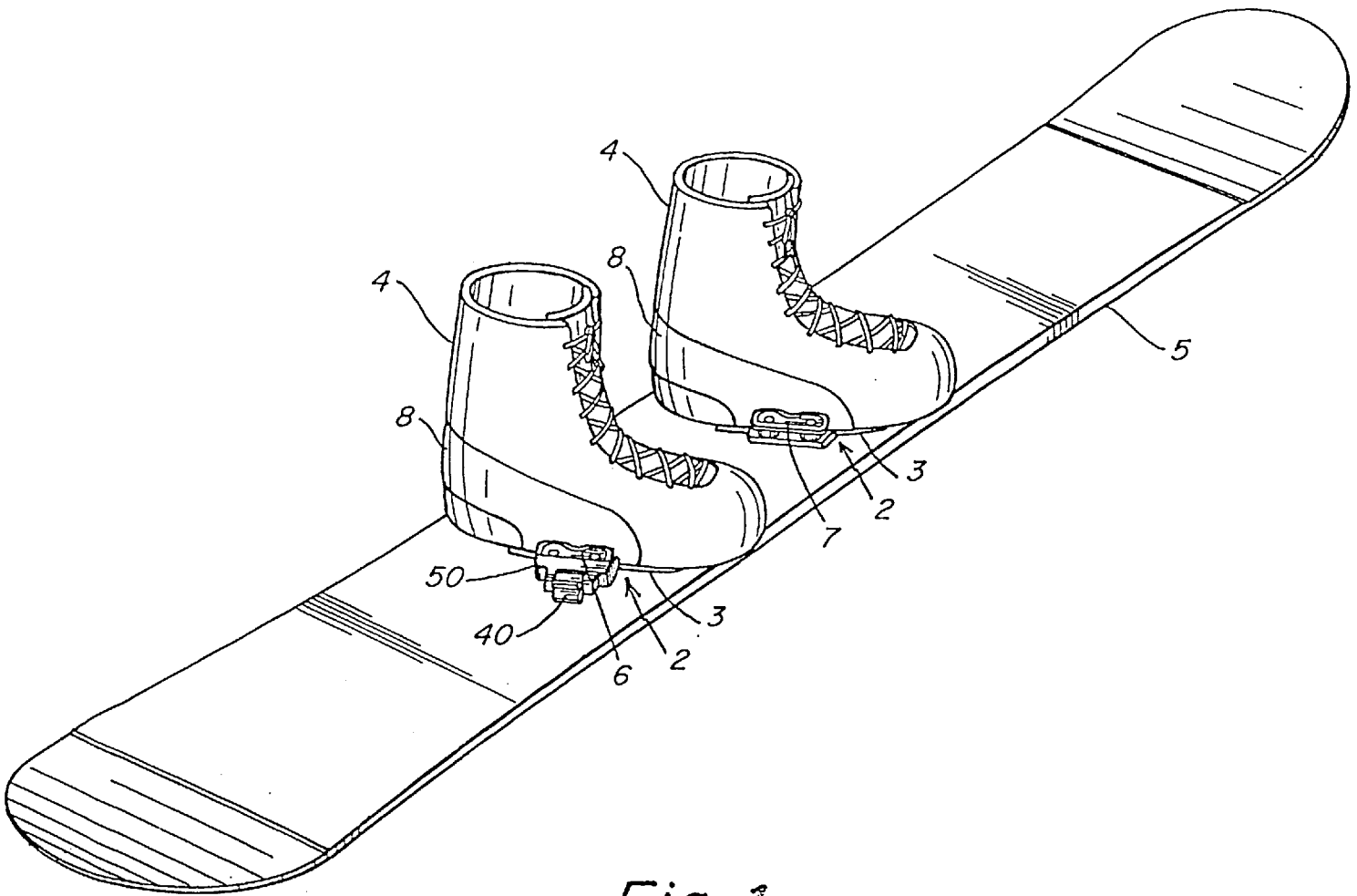
FIG. 1 is a perspective view of two bindings in accordance with the present invention, each mounted on a snowboard and receiving a boot.

FIG. 1 is a perspective view of a pair of snowboard boots 4 mounted to a snowboard 5 via a pair of bindings 2 in accordance with one illustrative embodiment of the present invention. The bindings each may include a hold down disc, discussed below, that enables the angle of the rider's feet relative to the longitudinal axis of the snowboard to be adjusted to a position that the rider finds most comfortable. The bindings 2 each includes a pair of engagement members for engaging the lateral sides of the boots, and a handle 40. The binding is constructed and arranged so that the engagement members automatically lock the boot 4 in the binding when the rider steps into the binding, without requiring actuation of the handle 40. The handle 40 is used only to move the binding from a locked position to an unlocked position, and can do so without substantial force from the rider.

The binding of the present invention enables quick and easy engagement and disengagement of the rider's boots with the board. Before beginning a run, the rider simply steps into the bindings 2, which causes the engagement members to automatically secure the boots 4 to the board 5. At the completion of the run, the rider can lift the handle 40 of the rear binding to disengage the binding and free the rear boot, thereby enabling the rider to use the rear leg to push the snowboard along the chair lift. After the handle 40 is lifted and the rider steps out, the binding 40 automatically assumes the open position wherein it is prepared to receive and automatically engage the boot. Thus, after getting off the lift, the rider can simply step into the binding to automatically lock the boot in place, and begin the next run.

One illustrative embodiment of a binding 2 in accordance with the present invention is shown in FIGS. 2–10. The binding 2 includes a housing that includes a base plate 3 that is mounted to the snowboard and a cover 50 that covers the binding locking mechanism. The binding further includes a pair of engagement members 6 and 7 that are mounted to the housing. In the embodiment shown, engagement member 7 is fixed to baseplate 3 and engagement member 6 is movable, and in particular pivotable, with respect thereto. The binding is adapted to engage a snowboard boot 4 having lateral recesses 54 on either side for receiving the engagement members 6 and 7. The lateral recesses 54 may be provided in the boot via an interface 8, as described in co-pending U.S. patent application Ser. No. 08/584,053 which is incorporated herein by reference, which is a single-piece molded plastic part bonded to the sole of the boot. However, it should be understood that the invention is not limited in this respect, and that the binding of the present invention can be used with boots that are adapted in other ways to engage the binding.

Figure 2:
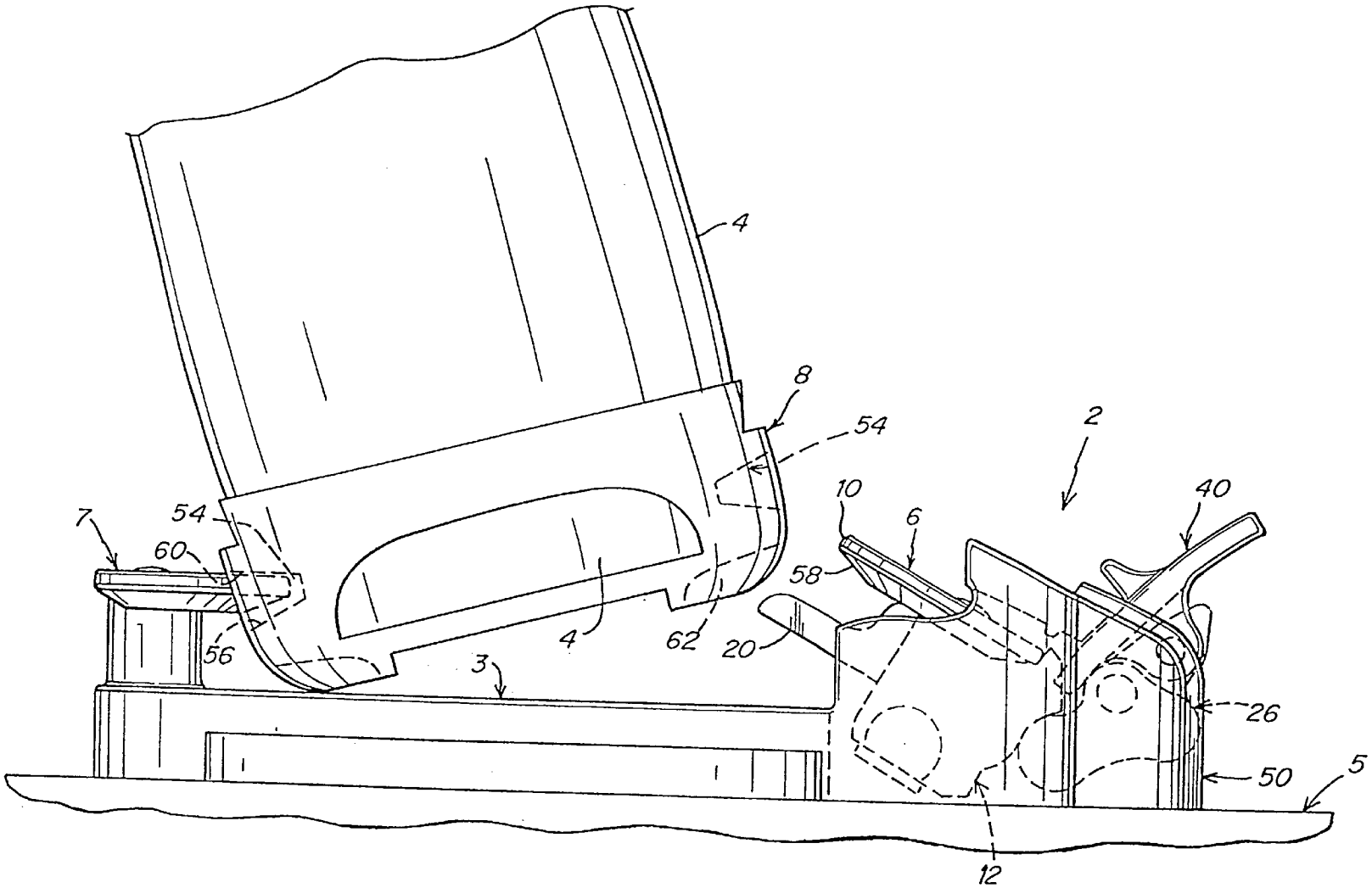
FIG. 2 is a rear view of a boot stepping into a binding in accordance with the present invention.
Figure 7:
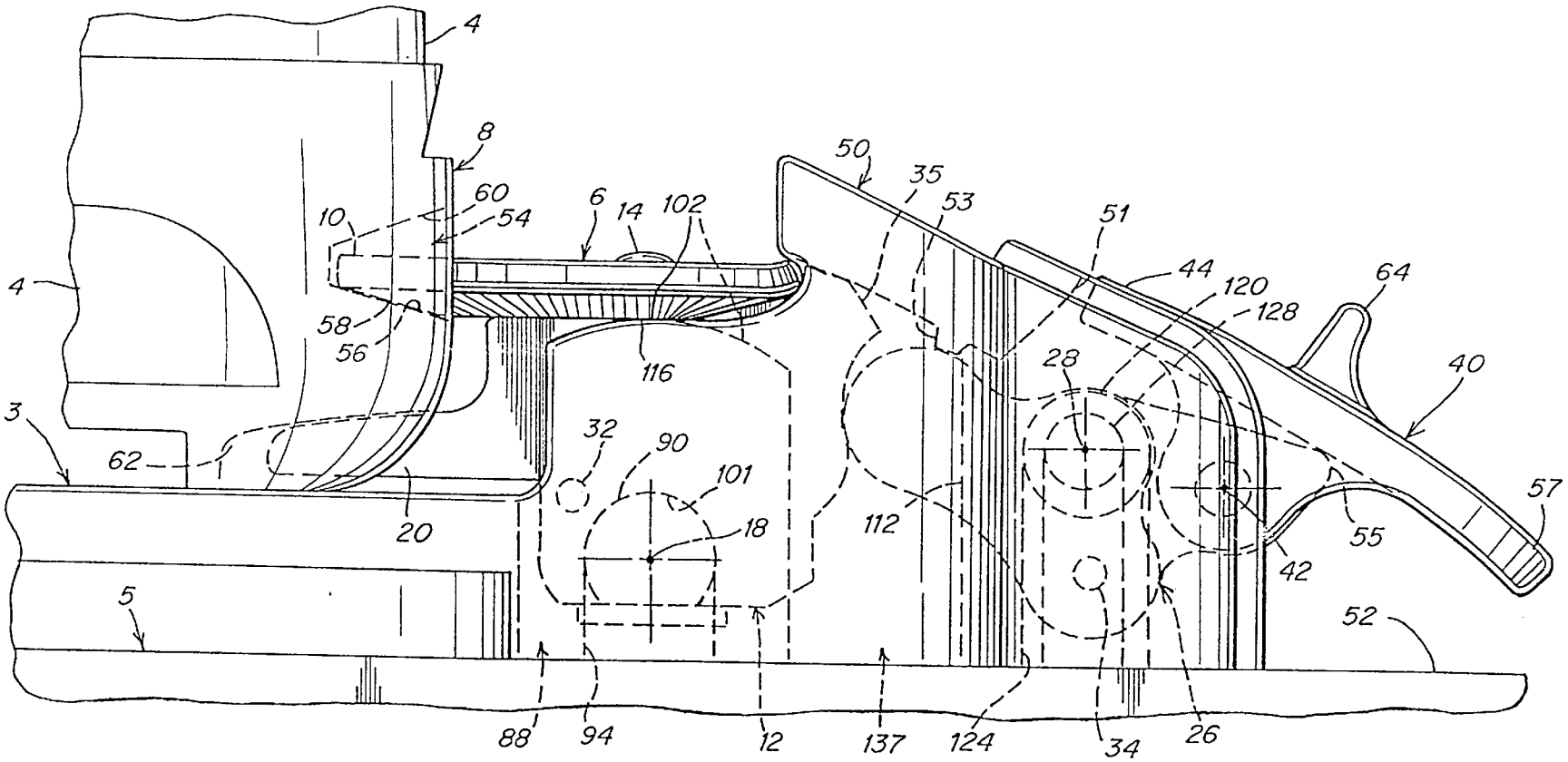
FIG. 7 is a partial rear view of the boot and binding of FIGS. 3–6, in which the binding is in the closed position and in which the cover and the handle are illustrated in the ready to ride position.

The rider steps into the binding by first aligning the fixed engagement member 7 with the recess 54 on the inside of the boot. As shown in FIG. 2, the engagement member 7 is arranged in a substantially horizontal configuration that extends substantially parallel to the baseplate 3 and the snowboard. Thus, the boot 4 is angled slightly when bringing the recess 54 into contact with the engagement member 7. To facilitate this process, the upper surface 60 of the recess is angled upwardly from the back of the recess to the edge of the boot, and the lower surface 56 of the recess is angled downwardly so that the recess is widened at its outer periphery to make it easier to insert the engagement member 7 into the recess. The lower surface 58 (FIG. 3) of the end 10 of each engagement member 6 and 7 may also be angled upwardly at the same angle that the lower surface 56 of the recess is angled downwardly to further facilitate mating of the recess with the engagement member. As seen in FIG. 7, the lower surface 58 of the engagement member lies flush against the lower surface 56 of the recess when the binding is closed. Examples of angles suitable for the recess surfaces and the engagement member include angles ranging from ten to twenty-five degrees. However, it should be understood that the present invention is not limited to any particular range of angles, or even to requiring that the recess and/or engagement member be angled at all. All that is required is that the engagement member and recess have compatible shapes that enable the rider to step into the binding and to provide sufficient engagement forces to hold the boot in the binding.

After the recess 54 on the inside of the boot is mated with the fixed engagement member 7, the rider steps down on a trigger 20 disposed on the other side of the binding. The trigger 20 is mechanically coupled to the movable engagement member 6 in a manner described below, such that when the rider steps down on the trigger 20, the end 10 of member 6 is moved into engagement with the recess 54 on the outside of the boot. In one embodiment of the invention, the binding includes an active locking mechanism so that after the rider steps down on the trigger and advances it past a bistable trigger point, the locking mechanism actively brings the movable engagement member 6 into a fully closed position wherein the binding is closed and the boot is held between the engagement members 6 and 7. Thereafter, the binding can be opened by lifting the handle 40 in the manner described below.

In the embodiment shown in the figures, the boot 4 is provided with a sole recess 62 that is adapted to receive the trigger 20. This recess can be provided in the interface 8, or in any number of other ways. The recess 62 permits the bottom of the boot to sit flat on the binding plate 3 when the binding is fully closed, as seen in FIGS. 5–8, without interference from the trigger 20. Furthermore, the rider can use the recess 62 to align the boot with the binding to ensure that the boot is properly positioned to receive the end 10 of the engagement member 6 when the rider steps down on the trigger. However, although the sole recess provides these advantages, it should be understood that the invention is not limited to use with a boot that includes such a recess. For example, the binding mechanism can be constructed so that the trigger does not extend parallel to the binding plate in the locked position, but rather, is received in a recess provided in the binding plate when the binding is in the locked position.

One illustrative embodiment of a locking mechanism for use in a binding in accordance with the present invention is shown in FIGS. 3–8, which are partial rear views illustrating a boot stepping into the binding so that the binding moves from the open to the closed position. The locking mechanism includes a rocker 12 that mechanically couples the engagement member 6 to the trigger 20. The rocker is pivotally mounted, about an axis 18, within a binding cover 50 that is cut away in FIGS. 3–6, but shown in FIGS. 7 and 8. The trigger 20 and rocker 12 can be formed from a single molded plastic piece. In the embodiment shown, the engagement member 6 is a metal piece that is fixedly attached to the rotatable rocker 12 by a pair of rods 14 best shown in the exploded views of FIGS. 9 and 10. The rods 14 extend through holes in the engagement member 6 and rocker 12, and are peened over a washer (not shown) underneath the rocker. The fixed engagement member 7 (FIGS. 2 and 9–10) can be attached to the binding housing in the same manner. Furthermore, it should be understood that the engagement members can alternatively be attached to the binding in a number of other ways.

The rocker 12, engagement member 6 and trigger 20 are arranged so that when the binding is in the open position, the rider can step into the binding and onto the trigger 20 without interference from the engagement member 6. Furthermore, as the binding moves into the closed position, the member 6 is brought into engagement with the boot recess 54. In one embodiment of the invention, the rocker 12, and consequently the trigger 20 and engagement member 6 that are fixed thereto, rotates from the open to the closed position through an angle A (FIG. 3) equal to approximately thirty degrees. However, it should be understood that by altering the dimensions of the trigger 20 and engagement member 6, as well as the angle of rotation of the rocker, a number of different configurations can be achieved. All that is required is that the binding be arranged so that when it is in the open position, the rider can step into the binding and onto the trigger 20 without interference from the engagement member 6, and thereby cause the member 6 to be brought into engagement with the boot recess 54 as the boot is advanced into the binding.

The rocker, latch plate and trigger are preferably dimensioned and configured so that the boot, trigger and engagement member mesh together like a gear when the rider steps into the binding. As stated above, in one embodiment of the invention, the rocker rotates through an angle of approximately 30° between the open and closed positions, and the bottom surface of the end of the engagement member is angled at approximately 20° to match the lower surface 56 of the boot recess. The trigger is slightly longer than the engagement member, and in one embodiment is approximately twenty-five mm long. The shape of the sole recess 62 (FIG. 7) on the boot can be manipulated to control the rate at which the engagement member 6 closes as the boot steps down on the trigger. In the embodiment shown, the upper surface of the recess is arched from the inside of the foot to the outside, and matches a radius on the upper surface of the trigger. In the embodiment shown, the radius for each arc is approximately fifteen mm. The arc on the upper surface of the recess causes the engagement member to close more quickly than if the recess was formed in a rectangular shape.

The mechanism of the binding that locks the pivotal engagement member 6 into the closed position is now described making reference to FIGS. 3–10. The locking mechanism includes a cam 26 that is pivotally mounted within the binding cover 50, about an axis 28, in a manner described below. The cam 26 is arranged to enable the rocker to rotate from the open to the closed position. In the closed position, the cam engages the rocker 12 to prevent it and the engagement member 6 fixed thereto from rotating back to the open position unless and until the handle 40 is actuated to open the binding.

Figure 3:
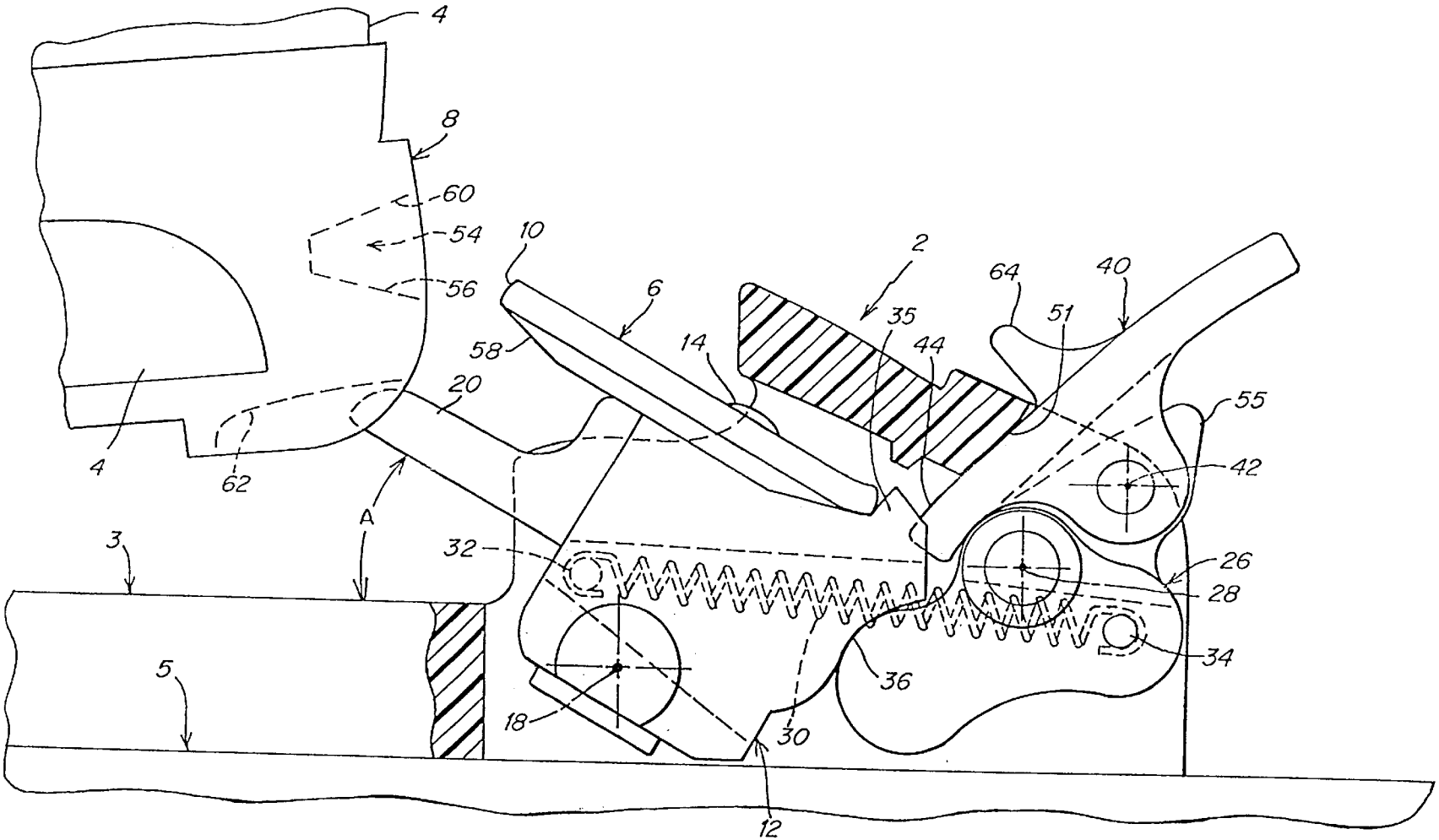
FIG. 3 is a partial rear view of one illustrative embodiment of the binding of FIG. 2, in which the binding cover is removed to illustrate the locking components of the binding.

When the binding is in the open position depicted in FIG. 3, the cam 26 and rocker 12 meet at a contacting surface 36. The binding is held in the open position of FIG. 3 by a pair of tension springs 30 (only one of which is shown in phantom in FIG. 3) that is attached between the rocker 12 and the cam 26, with the springs extending substantially parallel to one another and being spaced apart about a central axis 9 (FIG. 9) of the engagement member 6. The springs are disposed through channels in the rocker 12 and cam 26 and are mounted to rods 32 and 34 respectively disposed in rocker 12 and cam 26. The springs 30 act to pull the rods 32 and 34 toward one another, thereby causing the rocker 12 and cam 26 to each be biased for clockwise rotation about their respective axes 18 and 28. Biasing the rocker in the clockwise direction causes the binding to stay in the open position shown in FIG. 3, with the contact 36 between the inwardly curved surface of the rocker and the outwardly curved surface of the cam limiting the amount of clockwise rotation of the rocker and cam. As will be appreciated from the discussion below concerning the manner in which the rocker 12 is mounted within the binding cover 50, the amount of clockwise rotation of the rocker is further limited by engagement between an upper section 35 of the rocker and an inner surface 112 (FIG. 10) that defines an opening 137 in the binding cover.

The binding handle 40 is pivotally mounted to the cam 26 about a rod 42, which is mounted through holes in the cam and the handle as discussed below, and provides an axis of rotation for the handle relative to the cam. The handle is biased in the clockwise direction by a torsion spring (not shown) wrapped around the rod 42. In the open position, a lip 164 (FIG. 9) of the inner end 44 of the handle is received in a recess 37 (FIG. 9) in the section 35 of the rocker 12. Furthermore, the upper surface of the handle adjacent its inner end 44 contacts an inner surface 51 (FIGS. 7–9) of the binding cover, which limits clockwise rotation of the handle 40 when the binding is in the open position.

Figure 4:
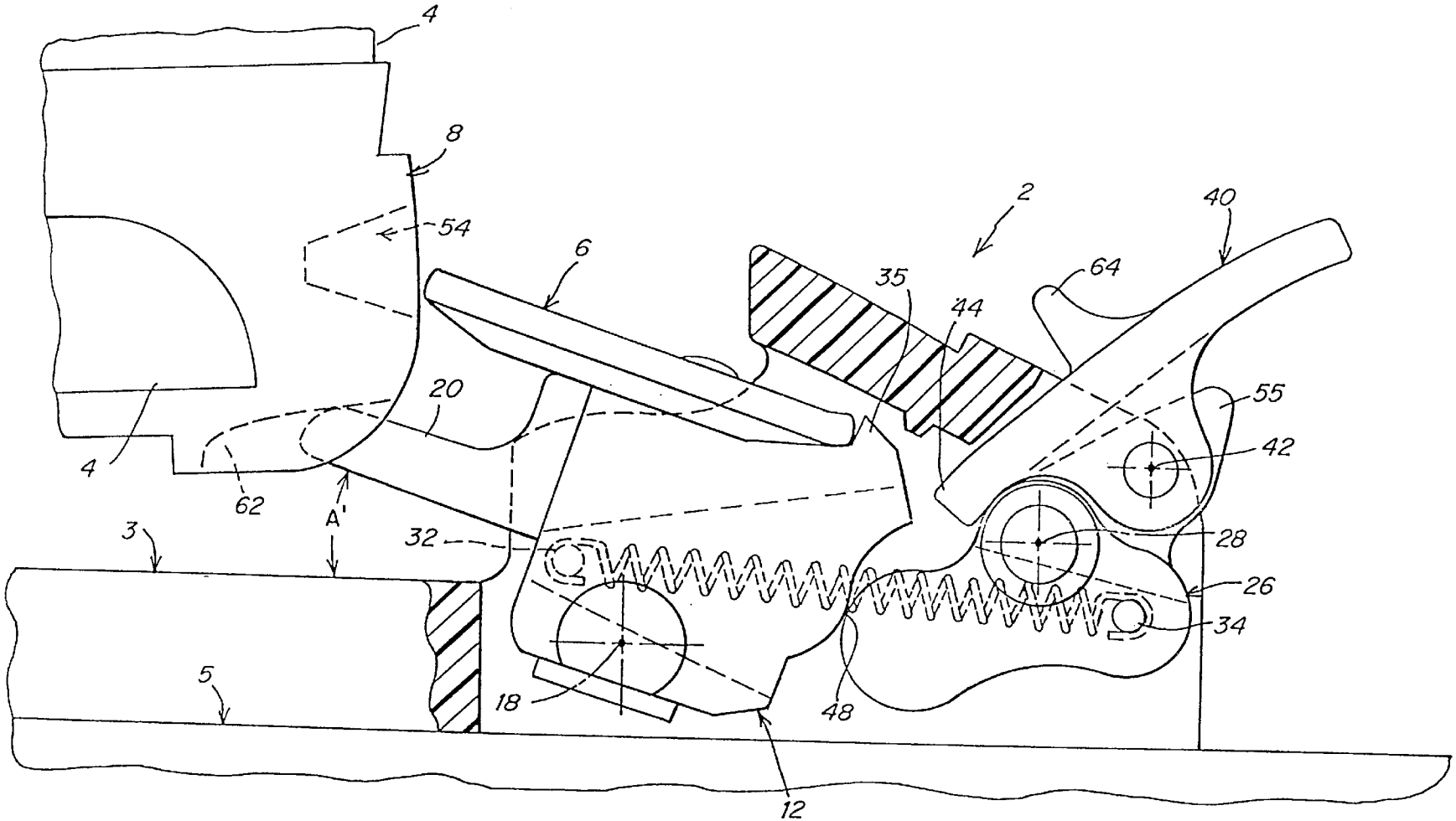
FIG. 4 is a partial rear view of the boot and binding of FIG. 3 in which the boot has partially engaged the binding trigger.

FIG. 4 illustrates the movement of the locking components as the rider steps into the binding and onto the trigger 20. In FIG. 4, the inner surface of the trigger recess 62 of the rider's boot 4 has contacted and displaced the trigger 20, and consequently the rocker 12 and engagement member 6 fixed thereto, approximately ten degrees in the counterclockwise direction so that the angle A' between the bottom of the trigger and the binding plate is approximately twenty degrees. As stated above, the cam 26 is biased in the clockwise direction by the pair of springs 30. Because of the contours of the outer surface of the rocker 12 and the inner surface of the cam 26, rotation of the rocker in the counterclockwise direction permits the cam to rotate in the clockwise direction while remaining in contact with the rocker at 48. If the rider were to lift the boot up away from the binding when in the position shown in FIG. 4, the force of the tension springs 30 would cause the binding to revert to the open position of FIG. 3.

Figure 5:
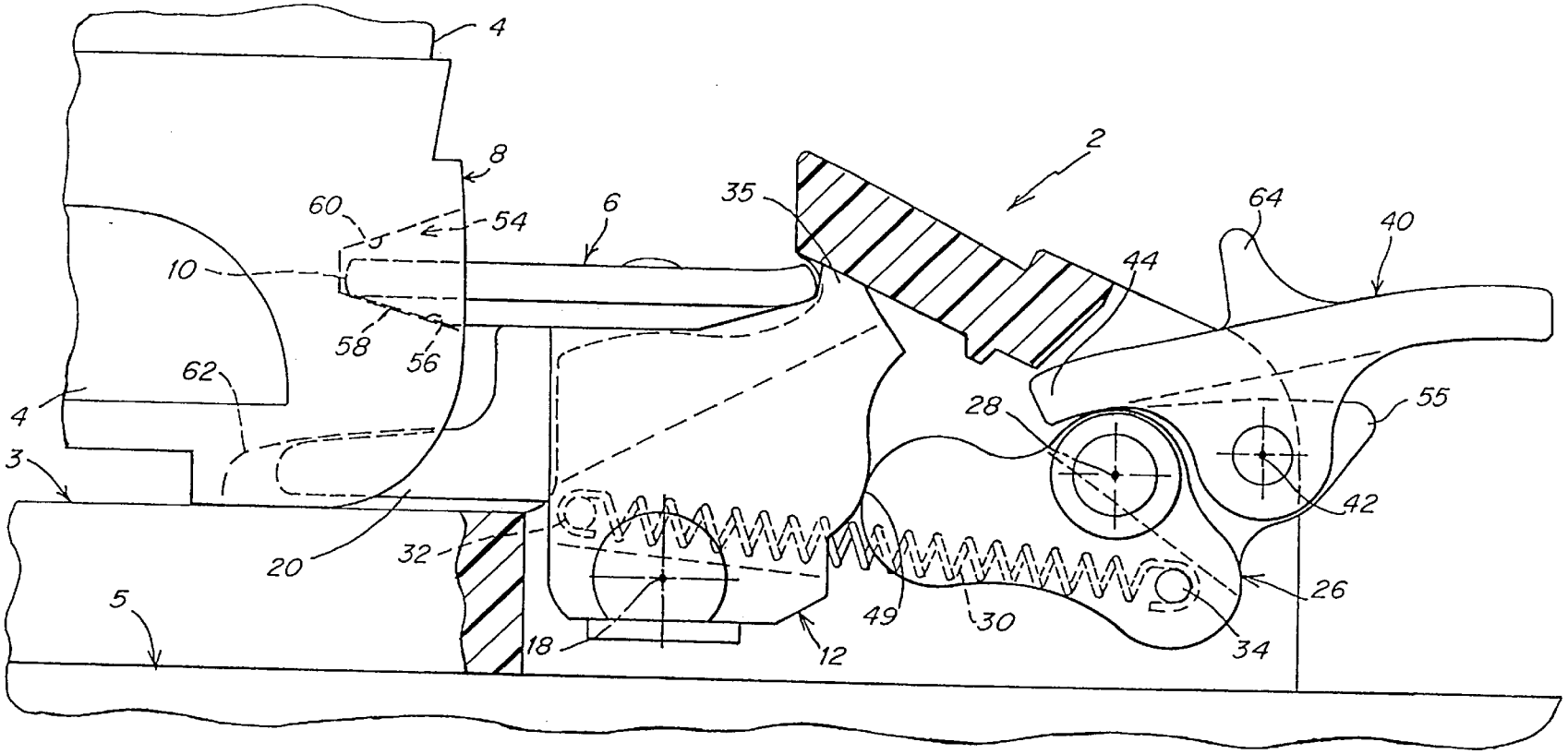
FIG. 5 is a partial rear view of the boot and binding of FIGS. 3–4, in which the boot has fully engaged the binding and moved the binding to a bistable position.

As the trigger 20 is further depressed by the rider's boot, the rocker 12 continues to rotate in the counterclockwise direction, which in turn permits the cam 26 to rotate further clockwise under the force of the tension springs 30. FIG. 5 illustrates the configuration of the binding when the rider has completed the process of stepping into the binding and the trigger 20 is rotated fully forward to a position wherein it is substantially parallel with the snowboard. Thus, the bottom surface of the boot interface 8 lies flat on the binding plate 3, with the trigger 20 being received in the recess 62. In the configuration of FIG. 5, the contact 49 between the cam 26 and the rocker 12 is unstable, in that the cam is not locked into a fixed engagement with the rocker in this configuration. From this position, the force of the tension springs 30 automatically causes the cam to snap into the position shown in FIG. 6, in which the binding is configured in an over-center arrangement that locks the engagement member 6 into position in the boot recess 54 to lock the boot into the binding.

Figure 6:
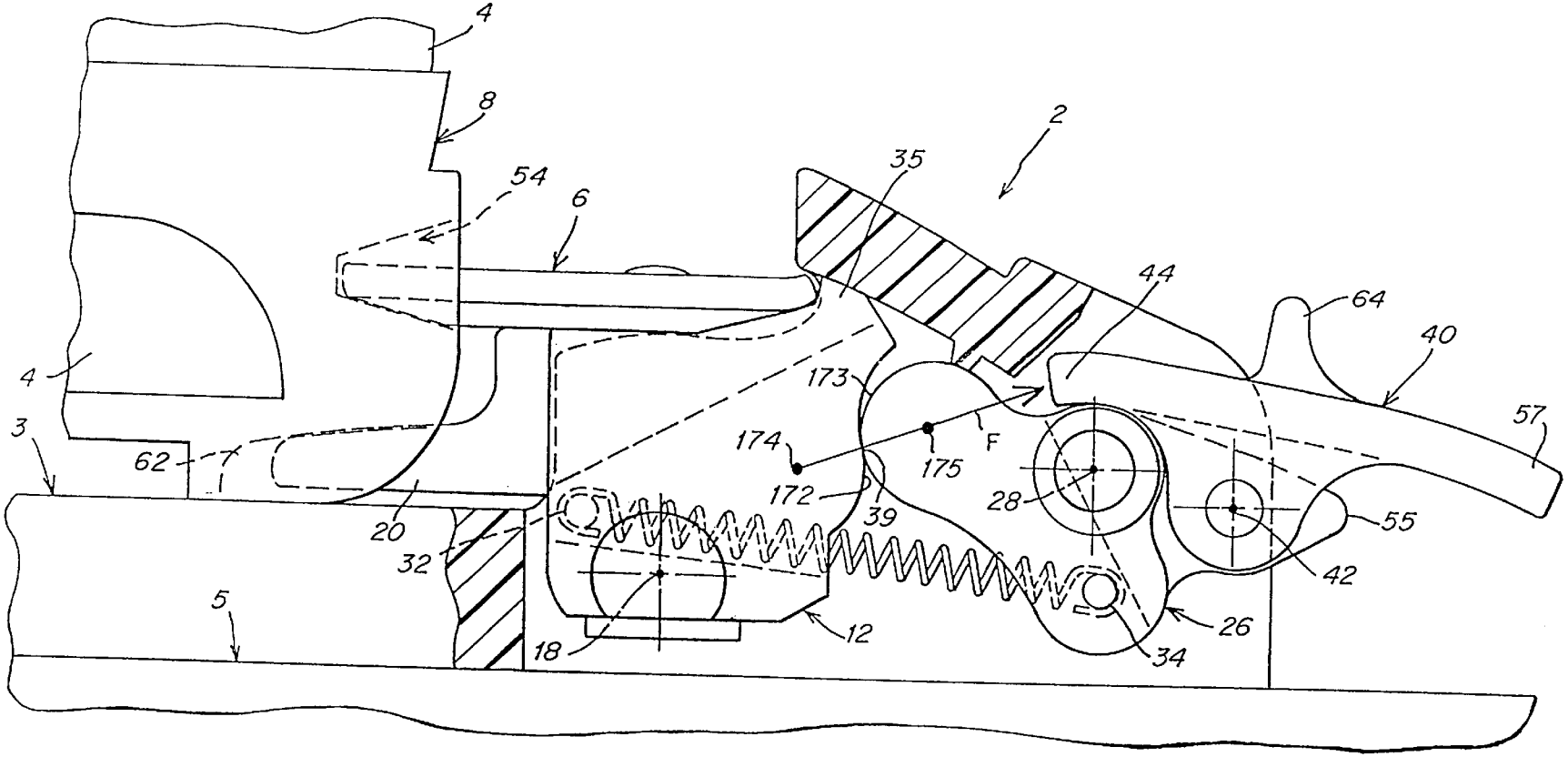
FIG. 6 is a partial rear view of the boot and binding of FIGS. 3–5, in which the cam has moved into an over-center position to lock the binding in the closed position.

In the fully locked position of FIG. 6, the rocker 12 and cam 26 meet at contact surface 39, wherein the outer curved surface 172 of the rocker mates with the inwardly curved surface 173 of the cam. The contact surface 39 is a linear surface that is tangent to each of the two contacting curved surfaces 172 and 173. As will be appreciated by those skilled in the art, the line of force generated on the rocker and cam by the linear contact surface between them extends normally from the contact surface 39, which is tangent to the curved surfaces. Thus, when a lifting force from the boot is generated that would tend to rotate the rocker clockwise into an open position, the rocker translates the force along a force line F that extends between the centers 174 and 175 of the curved surfaces 172 and 173, as shown in FIG. 6. This force tends to rotate the cam clockwise about its pivot axis 28, ensuring that the binding stays closed. Thus, once the binding assumes the closed and over-center configuration of FIG. 6, no amount of lifting force on the rocker will open the binding because such forces act to keep the binding closed.

As seen from the foregoing, the shapes and configurations of the rocker 12 and cam 26 ensure that the binding will remain locked, such that the tension springs 30 are not necessary to keep the binding locked. In this regard, once the binding is locked, it would stay in this position even if the springs were not present. Thus, the springs 30 need only provide sufficient force to hold the binding open as discussed above in connection with FIGS. 2 and 3, and to snap the cam into the over-center position from the unstable position of FIG. 5 when the trigger is fully depressed.

It should be understood that the present invention is not limited to the particular configurations of the rocker 12 and cam 26 shown in the figures, as other configurations are possible that would achieve the same results.

As discussed above, when the binding is in the open position of FIG. 3, clockwise rotation of the handle 40 is limited by engagement with the binding cover 50. However, as the cam 26 rotates from the open position to the over-center position of FIG. 6, the axis 42 about which the handle 40 is mounted to the cam rotates about the cam axis 28 in a clockwise direction until the inner end 44 of the handle clears the inner surface 51 of the binding cover 50, as best shown in FIG. 7. As a result, when the cam snaps to the over-center position and the end 44 of the handle clears the cover edge 51, the handle is free to pivot clockwise about its axis 42 under the force of the torsion spring. Clockwise rotation of the handle 40 in this closed configuration is limited by engagement with an outer section 55 of the cam. The section 55 of the cam and the handle are configured so that when they engage, the handle sits flush with the binding cover along the outer surface of the binding as shown in FIG. 7. This provides a visual cue to the rider that the binding is fully closed and in a ready to ride position. In this position, the free end 57 of the handle is positioned quite close to the surface 52 of the snowboard (e.g., approximately one quarter inch), thereby minimizing the risk of branches, snow or other objects getting underneath the handle and lifting it inadvertently to release the binding while riding.

Figure 8:
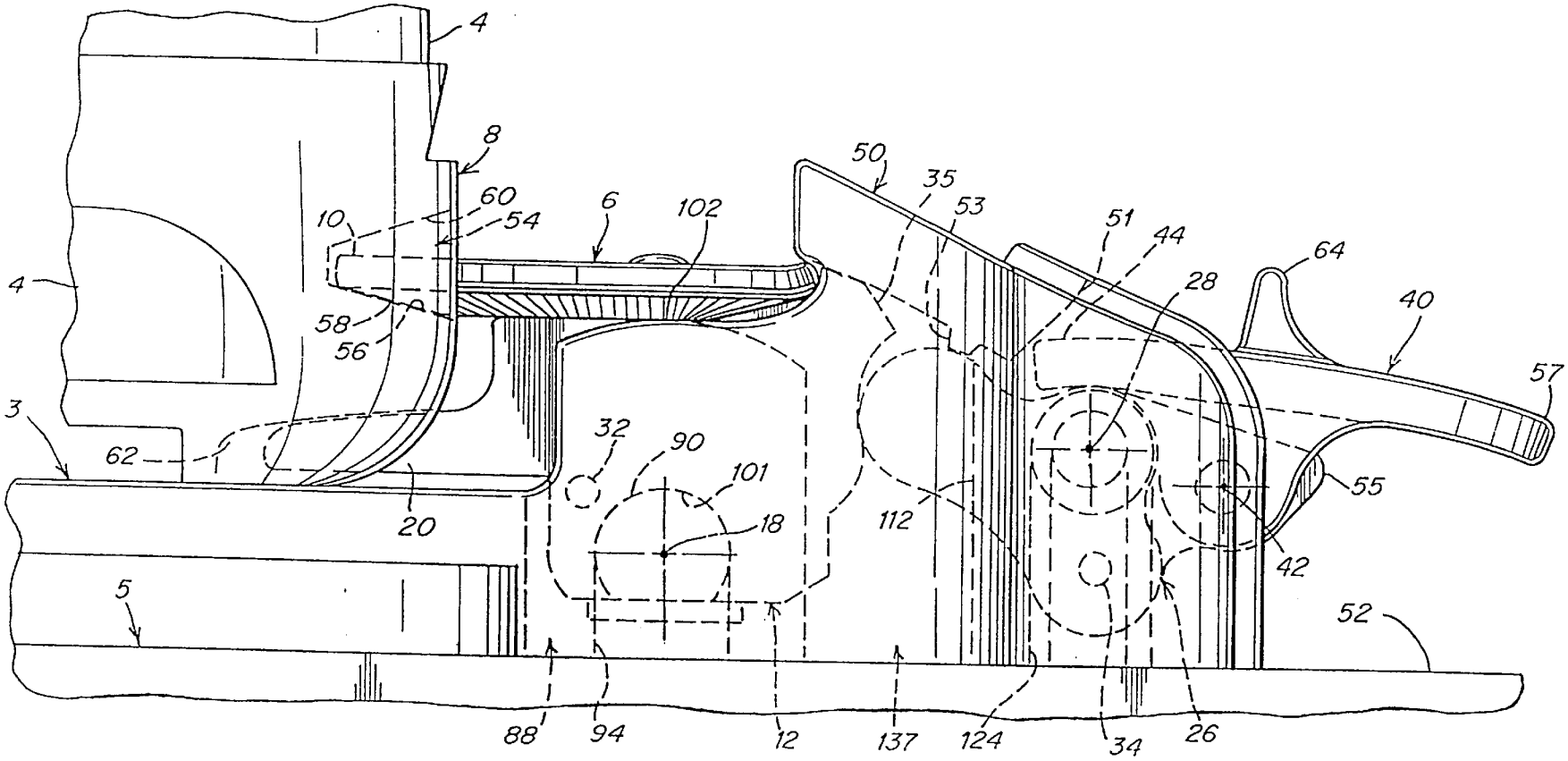
FIG. 8 is the partial rear view of the boot and binding of FIGS. 3–7 with the binding in the closed position and the handle in the ready to open position.

The binding cover 50 is shown in FIGS. 7 and 8, with the rocker 12, cam 26 and the inner surface 51 of the cover being shown in phantom. The inner surface 51 of the binding cover includes a flange 53 that serves two purposes. First, the flange acts to limit rotation of the cam 26 in the clockwise direction when the binding is in the closed position. Second, the flange is adapted to be contacted by the cam when the cam snaps into the over-center position, thereby creating a popping sound that provides an audio indication to the rider that the binding is in the locked and ready to ride position.

To move the binding into the open position to release the boot, the rider lifts the handle 40 to rotate it in the counter-clockwise direction about its pivot axis 42. As discussed above, the end 57 of the handle is disposed close to the surface 52 of the snowboard 5 when the binding is in the closed position. Thus, to facilitate the positioning of the rider's fingers under the end 57, the handle includes a flange 64 that can be used to rotate the handle to a ready to open position shown in FIG. 8, making it easier to fit the rider's fingers under the handle. As discussed above, the handle includes a torsion spring that biases it in the clockwise direction so that if the rider releases the handle when in the position of FIG. 8, the handle reverts back to the ready to ride position of FIG. 7.

To open the binding, the rider lifts the free end 57 of the handle 40 so that the inner end 44 of the handle contacts the cam 26 at a location 61 that is disposed on the opposite side of the cam pivot axis 28 from the axis 42 about which the handle rotates. Thus, as the handle is rotated further in the counterclockwise direction, the engagement with the inner end 44 of the handle causes the cam 26 to rotate counter-clockwise about its pivot axis 28. Once the cam reaches the bistable position of FIG. 5, the binding is no longer in an over-center position such that a light lifting force applied on the side of the rider's boot that engages the pivotal engagement member 6 causes the rocker 12 to rotate clockwise into the open position of FIG. 3. Once the end of engagement member 6 clears the recess 54, the rider can simply step out of the binding. The tension springs 30 bias the binding to keep it in the open configuration of FIG. 2, so that the binding automatically assumes a configuration wherein it is ready to receive the rider's boot.

As should be appreciated from the foregoing, the over-center configuration of the binding of the present invention provides secure engagement of the rider's boot, such that the binding will not inadvertently open during riding. Furthermore, a relatively small amount of force is necessary for the rider to open the binding when desired. To rotate the handle to the open position, the rider must only overcome the relatively small force of the torsion spring that biases the handle, and then generate sufficient force to move the cam out of the over-center position.

Figure 9:
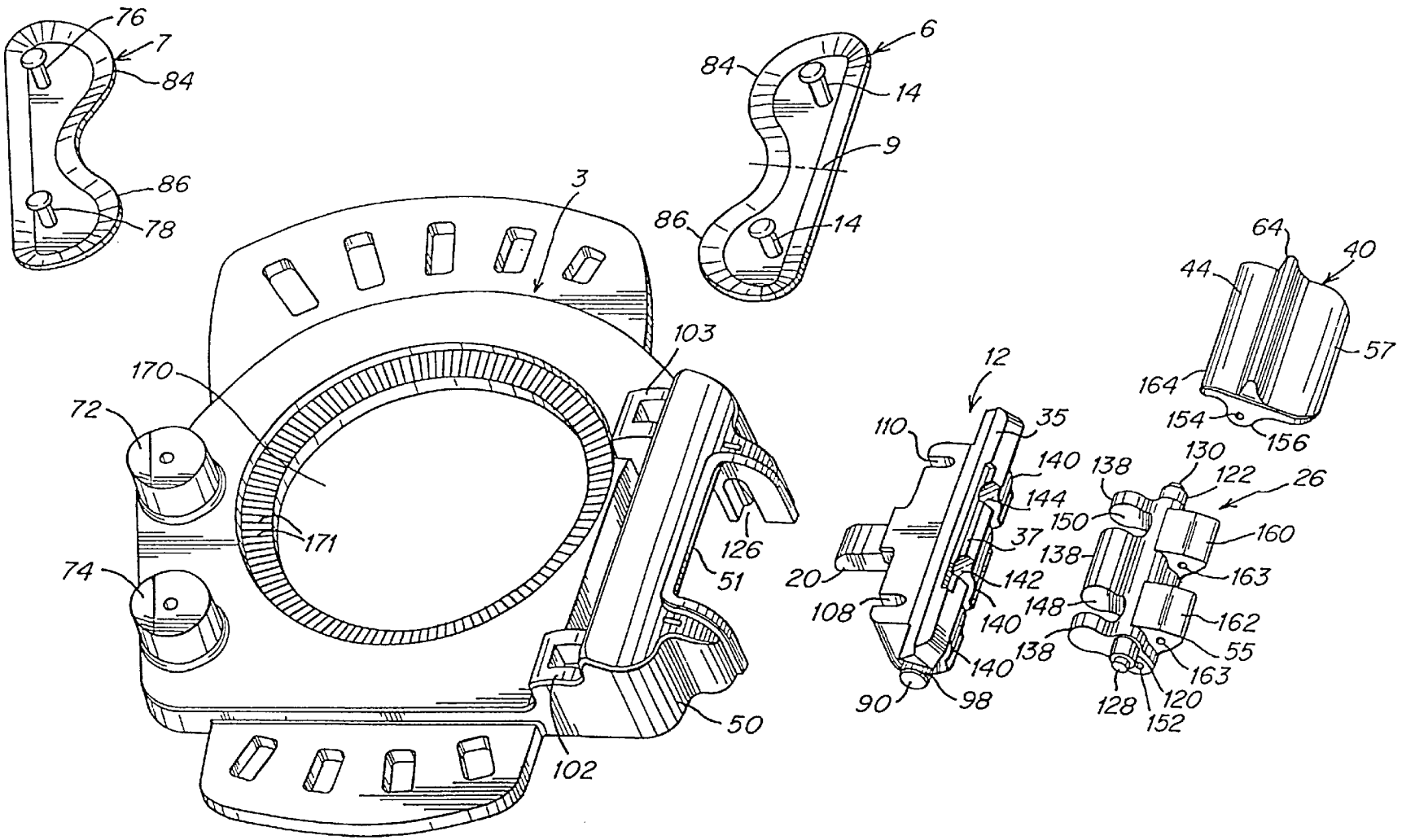
FIG. 9 is an exploded top view of the parts that make up the illustrative binding of FIGS. 3–8.
Figure 10:
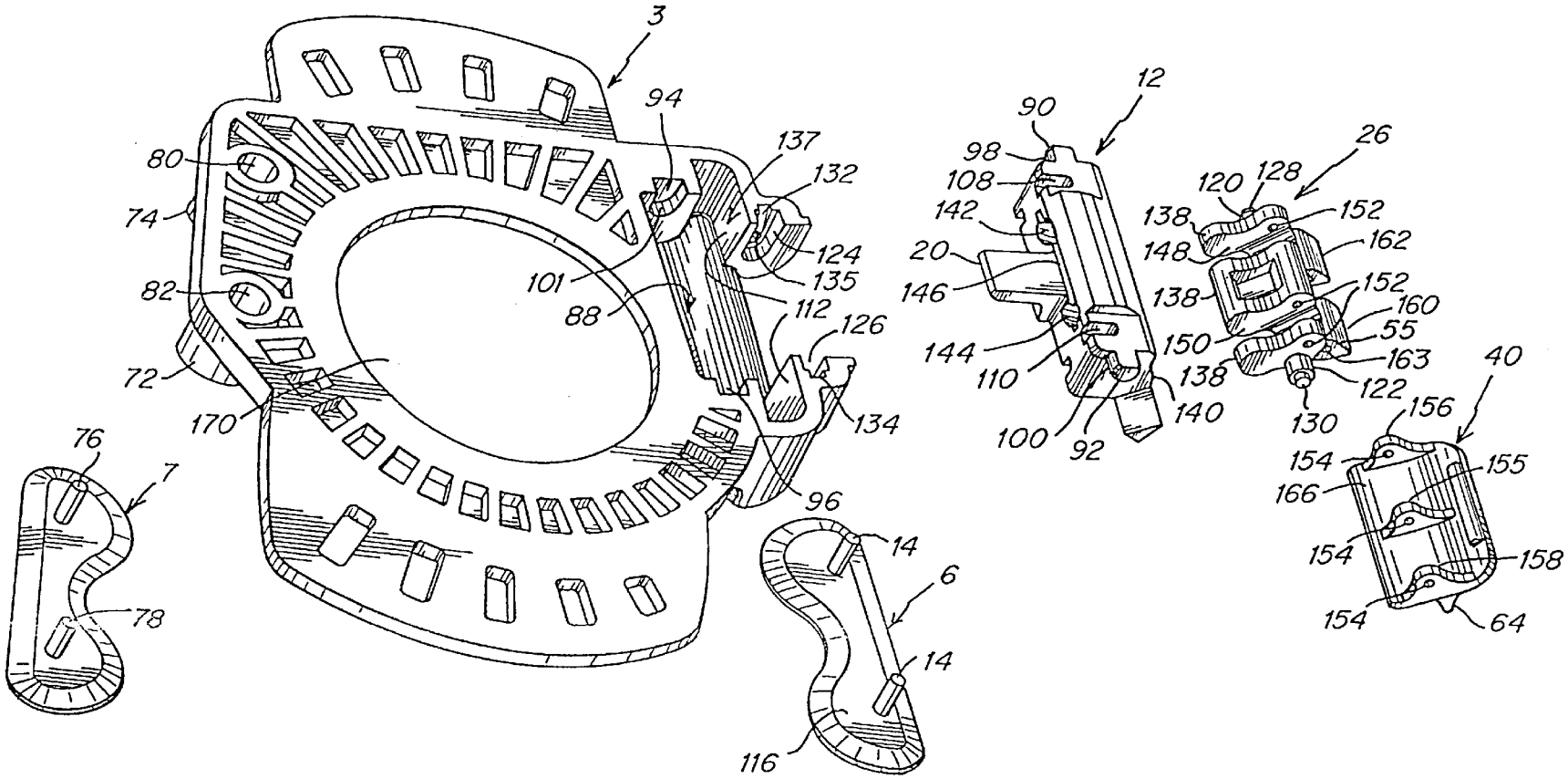
FIG. 10 is a bottom view of the parts of FIG. 9.

FIGS. 9 and 10 are respectively exploded top and bottom views of the various parts that can be used in implementing one illustrative embodiment of the binding of the present invention. The binding cover 50 and binding plate 3 can be formed as a single molded piece of plastic that further includes two substantially hollow posts 72 and 74 for receiving the fixed engagement member 7. The engagement member 7 can be a metal plate that is mounted on the posts 72 and 74 via metal rods 76 and 78 that respectively pass through openings in the posts 72 and 74. The rods can be peened over and attached via a washer disposed within recesses 80 and 82 (FIG. 10) respectively disposed within the posts 72 and 74. It should be understood that the present invention is not limited to any particular technique for attaching the engagement member 7 to the binding, and that other techniques can be used such as press fitting the rods 76 and 78 within bores in the binding housing.

In the embodiment shown, each engagement member 6 and 7 has a pair of engagement fingers 84 and 86 that is adapted to engage two identical recesses 54 (FIG. 7) formed on the lateral sides of the boot. The use of two spaced apart engagement fingers on each side of the boot is advantageous in that it strengthens the engagement between the binding and the boot, particularly when the boot recesses are formed from plastic. However, it should be understood that the present invention is not limited to a binding that uses dual engagement fingers.

As stated above, in one embodiment of the invention the engagement fingers 84 and 86 are angled upwardly to facilitate engagement with the downwardly angled lower recess surface 56 of the boot when the rider is stepping into the binding. However, the engagement fingers can be formed in any number of alternate configurations to mate with compatible recesses on the boot, and it should be understood that the present invention is not limited to the particular recess and engagement finger configuration shown in the figures. In the embodiment shown in the figures, the engagement members 6 and 7 are identical to reduce the number of distinct parts in the binding by making it unnecessary to have different engagement member configurations for engaging the inside and outside of the boot.

Binding cover 50 has a opening 88 for receiving the rocker 12. About its pivot axis 18 (FIG. 4), the rocker 12 includes ends 90 and 92 that are adapted to be slidably received in slots 94 and 96 along the inner surface of opening 88. Ends 90 and 92 have curved upper surfaces 98 and 100 for mating with corresponding curved surfaces in the slots 94 and 96 (only the curved surface 101 of slot 94 can be seen in the figures). The radius of curvature of the surfaces 98 and 100 matches the radius of curvature of the inwardly curved surfaces 101 to permit rotation of the rocker with respect to the binding housing through the angle A (FIG. 3) as the binding moves between the closed and open positions. The rocker is held in place in opening 88 by the engagement member 6, which is mounted on the rocker via rods 14 that pass through holes (not shown) in the engagement member and holes 108 and 110 in the rocker, and are fixed underneath the rocker in the same manner as rods 76 and 78 of the fixed engagement member 7 discussed above. Thus, the rocker 12 essentially hangs from the engagement member 6 via pins 14. The engagement member 6 sits atop a pair of housing surfaces 102 and 103 that are curved to enable the bottom surface 116 of the engagement member to slide over the surfaces through the angles of rotation achieved when the binding moves between the open and closed positions. During assembly, the rocker 12 is placed into the housing opening 88, and then the engagement member 6 is attached to the rocker to movably mount the rocker to the housing.

The binding housing also includes a pair of slots 124 and 126 for receiving the cam 26. Cam 26 includes a pair of ends 120 and 122 that are slidably received in slots 124 and 126, respectively. Ends 120 and 122 include small diameter sections 128 and 130 that are respectively snap fit into circular recesses (not shown) at the top of slots 124 and 126 to establish the cam pivot axis 28 (FIGS. 3–8). The slots 124 and 126 have ramps 132 and 134 adapted to slidably receive smaller diameter sections 128 and 130. The ramps are inclined toward and terminate at a lip 135 before the circular recesses that receive the small diameter sections. Thus, as the cam is slid into the slots 124 and 126, the small diameter sections 128 and 130 will contact the surface of the ramp. The binding cover is forced to spread apart slightly to accommodate the sections 128 and 130 until they clear the ramp lips and are snap fit into the circular recesses on the side of the slots 124 and 126.

An opening 137 in the binding cover provides the area in which the cam surface 138 (FIGS. 9 and 10) contacts the rocker surface 140 throughout the range of configurations between the open and closed positions of the binding. As stated above, tension springs 30 (FIG. 3) are attached at one end to the rocker and at the other end to the cam. The springs are attached to the trigger side of the rocker and pass through channels 142 and 144 in the rocker. The springs are attached to a metal rod 32 that is mounted in a groove 146 in the rocker that is disposed below the trigger and intersects both channels 142 and 144. The rod can be press fit in the groove 146. The springs pass through the rocker channels 142 and 144 and into openings 148 and 150 in the cam 26. A bore 152 (FIG. 10) extends through the width of the cam and is adapted to receive a rod 34 that intersects openings 148 and 150 and can be press fit in the bore. The spring ends are attached to the portions of the rod exposed by the openings 148 and 150. It should be understood that the above-described technique for mounting the springs between the rocker and cam is provided merely for illustration, and that numerous other techniques are possible.

The handle 40 is pivotally mounted to the cam 26 via a metal rod 42 (FIGS. 3–6) that defines the handle pivot axis. The rod passes through holes 154 defined in three sections 155, 156 and 158 of the handle, and through bores 163 in the cam. The section 155 of the handle is placed between two outer sections 160 and 162 of the cam, and sections 156 and 158 are respectively positioned outside the cam sections 160 and 162, such that the holes 154 of the three sections of the handle align with the bores 163 in the sections 160 and 162 of the cam. A torsion spring (not shown) is wrapped around the rod and acts against the handle surface 166 (FIG. 10) to bias the handle to the ready to ride position as discussed above.

In the embodiment of the invention shown in the figures, the binding plate 3 includes an opening 170 for receiving a hold-down disc used to mount the binding to the snowboard in any of a number of rotational orientations relative to the snowboard. Ridges 171 in the plate are adapted to mate with corresponding ridges on the hold down disc. An example of a hold-down disc suitable for use with the binding of the present invention is disclosed in U.S. Pat. No. 5,261,689, which is incorporated herein by reference. However, it should be understood that the present invention is not limited to use with this or any other hold-down disc.

The binding of the present invention has been described above as being used to engage a soft snowboard boot. Although well adapted to this application, it should be understood that the present invention is not limited in this respect, and that the binding of the present invention can be used to engage hard snowboard boots, ski boots or any of a number of other types of footwear.

The foregoing description has primarily illustrated a right foot binding. It should be understood that the left binding can simply be a mirror image of the right binding, with the moveable engagement member 6 and handle 40 being disposed on the outside of the foot. Alternatively, the movable engagement member and the handle could be configured on the inside of the binding.

As stated above, a number of the binding components (e.g., the engagement members 6 and 7) can be made from metal. The present invention is not limited to any particular type of metals, but examples include stainless steel, carbon steel and aluminum. Similarly, the molded plastic components can be formed from any suitable material. In one embodiment of the invention, the molded plastic parts are formed from long fiber glass filled materials, such as nylon, polyurethane, polycarbonate and polypropylene. Long fiber glass filled materials are advantageous in that they maintain their impact strength at relatively cold temperatures where other materials may become brittle. However, the present invention is not limited to use with such materials.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. In a snowboard binding for securing a snowboard boot to a snowboard, the snowboard binding including a base, an engagement apparatus comprising:

a pair of engagement members supported by the base and including first and second spaced apart engagement members adapted to separately engage first and second sections of a first side of the snowboard boot while being spaced from a third section of the first side of the snowboard boot disposed therebetween the pair of engagement members including an open position and a closed position respectively corresponding to open and closed configurations of the binding, wherein the first engagement member is disposed forwardly of the second engagement member and is arranged to engage an instep area of the snowboard boot; and a trigger, supported by the base, that is adapted to be stepped down upon by the boot to cause the pair of engagement members to move from the open position to the closed position.

2. The engagement apparatus of claim 1, wherein the trigger is pivotally mounted to the base.

3. The engagement apparatus of claim 2, wherein each of the first and second spaced apart engagement members is arranged to engage an instep area of the snowboard boot.

4. The engagement apparatus of claim 2, wherein the trigger has an open state and a closed state respectively corresponding to the open and closed positions of the pair of engagement members, and wherein the trigger is arranged to underlie a sole of the snowboard boot when the trigger is in the closed state.

5. The engagement apparatus of claim 1, further comprising a handle mechanically coupled to the pair of engagement members to move the pair of engagement members from the closed position to the open position.

6. The engagement apparatus of claim 5, wherein the handle is pivotally mounted relative to the base, and wherein the binding is constructed and arranged so that when the handle is pivoted downwardly toward the base, the pair of spaced apart engagement members is moved toward the open configuration.

7. The engagement apparatus of claim 5, wherein the handle is pivoted in a first direction as the binding moves from the open configuration to the closed configuration, and wherein the engagement apparatus is constructed and arranged so that when the binding is closed, lifting forces acting on the pair of spaced apart engagement members act to pivot the handle in the first direction.

8. The engagement apparatus of claim 5, wherein the handle is biased by a torsion spring.

9. The engagement apparatus of claim 1, wherein each of the first and second spaced apart engagement members is arranged to engage an instep area of the snowboard boot.

10. The engagement apparatus of claim 9, wherein the pair of engagement members is pivotally mounted to the base about an axis that is substantially parallel to a longitudinal extent of the snowboard binding.

11. The engagement apparatus of claim 1, wherein the first and second engagement members each is movably mounted to the base, and wherein the pair of spaced apart engagement members is constrained to move, relative to the base, together as a single unit, such that the first and second engagement members are not independently movable relative to the base.

12. The engagement apparatus of claim 1, wherein the pair of spaced apart engagement members are part of a unitary component.

13. The engagement apparatus of claim 1, wherein each of the pair of engagement members is formed of metal.

14. The engagement apparatus of claim 1, wherein the pair of engagement members is pivotally mounted to the base about an axis that is substantially parallel to a longitudinal extent of the snowboard binding.

15. The engagement apparatus of claims 1, wherein the first and second engagement members extend substantially parallel to the base when in the closed position.

16. The engagement apparatus of claim 1, wherein the pair of engagement members rotate downwardly toward the base when moving from the open position to the closed position.

17. The engagement apparatus of claims 1, wherein the trigger includes an open state and closed state respectively corresponding to the open and closed positions of the pair of engagement members, and wherein the trigger rotates downwardly toward the base when moving from the open state to the closed state.

18. The engagement apparatus of claim 1, wherein the pair of engagement members pivot through an angle of about 30° from the closed position to the open position.

19. The engagement apparatus of claim 1, wherein the trigger includes an open state and a closed state respectively corresponding to the open and closed positions of the pair of engagement members, and wherein the trigger pivots through an angle of about 30° from the closed state to the open state.

20. The engagement apparatus of claim 1, wherein the pair of engagement members and the trigger each is movably mounted to the base, and wherein the pair of engagement members and the trigger are constrained to move, relative to the base, together as a unit, such that the pair of engagement members and the trigger are not independently movable relative to the base.

21. The engagement apparatus of claim 1, wherein the pair of engagement members and the trigger are pivotally mounted to the base about an axis that is substantially parallel to a longitudinal extent of the snowboard binding.

22. The engagement apparatus of claim 1, wherein the trigger has an open state and a closed state respectively corresponding to the open and closed positions of the pair of engagement members, and wherein the trigger is arranged to underlie a sole of the snowboard boot when the trigger is in the closed state.

23. The engagement apparatus of claim 1, wherein the trigger has an open state and a closed state respectively corresponding to the open and closed positions of the pair of engagement members, and wherein when the pair of engagement members is in the closed position and the trigger is in the closed state, the trigger extends further toward a center of the base than the pair of engagement members.

24. The engagement apparatus of claim 1, wherein the trigger and the pair of engagement members are part of a unitary component.

25. The engagement apparatus of claim 1, wherein the trigger has an open state and a closed state respectively corresponding to the open and closed positions of the pair of engagement members, and wherein the trigger extends substantially parallel to the base when in the closed state.

26. The engagement apparatus of claim 1, wherein the trigger and the pair of engagement members are constructed and arranged such that when the boot steps into the binding the pair of engagement members does not interfere with the boot stepping down upon the trigger.

27. The engagement apparatus of claim 1, wherein the trigger is longer than each of the first and second engagement members.

28. The engagement apparatus of claim 1, wherein, when in the open position, the pair of engagement members is spring biased to remain in the open position.

29. The engagement apparatus of claim 1, in combination with the binding.

30. The combination of claim 29, wherein the first and second engagement members each is movably mounted to the base, and wherein the first and second engagement members are the only moveable engagement members on the binding adapted to engage the snowboard boot.

31. The combination of claim 29, wherein the snowboard binding further comprises at least one additional engagement member that is supported by the base and is adapted to engage a second side of the snowboard boot, opposite the first side, when the binding is in the closed configuration.

32. The engagement apparatus of claim 1, in combination with the snowboard boot.

33. The combination of claim 32, wherein the snowboard boot includes an interface disposed at the first side of the snowboard boot, and wherein the pair of engagement members is adapted to engage the interface to secure the snowboard boot to the binding.

34. The combination of claim 33, wherein the boot includes a sole and wherein the interface is mounted to the sole.

35. The combination of claim 33, wherein the interface includes an opening adapted to align the boot with the binding.

36. The combination of claim 35, wherein the opening adapted to align the boot with the binding is further adapted to receive the trigger.

37. The combination of claim 36, wherein the opening adapted to receive the trigger is shaped to control the rate at which the pair of engagement members closes.

38. The combination of claim 33, wherein the pair of engagement members is arranged to engage, from above, at least a portion of the interface to resist lifting forces generated on the snowboard boot.

39. The combination of claim 32, wherein the first side of the snowboard boot has at least one opening, and the pair of engagement members is adapted to be received within the at least one opening when the binding is in the closed configuration.

40. The combination of claim 39, wherein the first engagement member has a boot-facing surface that is adapted to be disposed within the at least one opening when the binding is in the closed configuration, and wherein the boot-facing surface is a curved surface.

41. The combination of claim 39, wherein the at least one opening has a lower wall that terminates substantially in-line with the first side of the snowboard boot.

42. The combination of claim 39, wherein the at least one opening has a periphery that terminates substantially in-line with the first side of the snowboard boot.

43. The combination of claim 32, wherein the first side of the snowboard boot is the inside of the snowboard boot, and wherein each of the first and second engagement members is arranged to engage the inside of the snowboard boot in the instep area.

44. The combination of claim 32, wherein the first side of the snowboard boot is the outside of the snowboard boot, and wherein each of the first and second engagement members is arranged to engage the outside of the snowboard boot in the instep area.

45. The combination of claim 32, wherein the boot is a soft snowboard boot.

46. A snowboard boot binding for securing a snowboard boot to a snowboard, the binding having an open position and a closed position, the binding comprising:

a base adapted to receive the snowboard boot;

a first engagement member mounted to the base for movement between an open configuration and a closed configuration respectively corresponding to the open and closed positions of the binding, the first engagement member being adapted to engage a first lateral side of the snowboard boot when in the closed configuration;

a second engagement member supported by the base and adapted to engage a second lateral side of the snowboard boot opposite the first lateral side when the binding is in the closed position; and a locking assembly having an open state and a closed state respectively corresponding to the open and closed positions of the binding, the locking assembly being arranged to lock the first engagement member in the closed configuration when the locking assembly is in the closed state, the locking assembly being constructed and arranged such that forces acting on the binding that tend to move the first engagement member toward the open configuration when the binding is in the closed position act to maintain the locking assembly in the closed state.

47. The binding of claim 46, in combination with the snowboard boot, wherein the lifting forces are generated by the snowboard boot.

* * * * *

UNITED STATES PATENT AND TRADEMARK OFFICE

CERTIFICATE OF CORRECTION

PATENT NO. : 6,460,871 B1
DATED : October 8, 2002
INVENTOR(S) : David J. Dodge

It is certified that error appears in the above-identified patent and that said Letters Patent is hereby corrected as shown below:

Please rewrite the paragraph beginning at Column 1 line 5 as follows:

-- This application is a continuation-in-part of application Serial No. 09/510,796, filed February 23, 2000, entitled SNOWBOARD BOOT BINDING MECHANISM, now pending, which is a continuation of application Serial No. 08/753,343, filed November 25, 1996, entitled SNOWBOARD BOOT BINDING MECHANISM, now U.S. Patent No. 6,050,005, which is a continuation of application Serial No. 08/674,976, filed July 3, 1996, entitled SNOWBOARD BOOT BINDING MECHANISM, now U.S. Patent No. 5,941,555, which is a file wrapper continuation of application Serial No. 08/375,971, filed January 20, 1995, entitled SNOWBOARD BOOT BINDING MECHANISM, now abandoned.

This application is also a continuation of U.S. application serial number 09/383,306, filed August 26, 1999 and entitled "Step-in Snowboard Binding", now issued as U.S. Patent No. 6,203,052, which is a continuation of U.S. application serial number 08/972,864, filed November 18, 1997 and entitled "Step-in Snowboard Binding", now issued as U.S. Patent No. 5,957,480, which is a continuation of U.S. application serial number 08/655,021, filed May 29, 1996 and entitled "Step-in Snowboard Binding", now issued as U.S. Patent No. 5,722,680, all of which are herein incorporated by reference. --

Signed and Sealed this

Twenty-second Day of July, 2003

JAMES E. ROGAN
*Director of the United States Patent and Trademark Office*